US008900781B2

(12) United States Patent
Ogawa

(10) Patent No.: US 8,900,781 B2
(45) Date of Patent: Dec. 2, 2014

(54) BINDER RESIN FOR PHOTOSENSITIVE LAYERS AND ELECTROPHOTOGRAPHIC PHOTORECEPTOR BELTS

(75) Inventor: Noriyoshi Ogawa, Ibaraki (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 1430 days.

(21) Appl. No.: 12/310,358

(22) PCT Filed: Aug. 21, 2007

(86) PCT No.: PCT/JP2007/066146

§ 371 (c)(1),
(2), (4) Date: Sep. 30, 2009

(87) PCT Pub. No.: WO2008/023676

PCT Pub. Date: Feb. 28, 2008

(65) Prior Publication Data

US 2010/0068640 A1 Mar. 18, 2010

(30) Foreign Application Priority Data

Aug. 23, 2006 (JP) ..... 2006-226778

(51) Int. Cl.
*G03G 5/047* (2006.01)
*G03G 5/05* (2006.01)

(52) U.S. Cl.
CPC ..... *G03G 5/0564* (2013.01); *G03G 5/0596* (2013.01); *G03G 5/056* (2013.01); *G03G 5/0578* (2013.01); *G03G 5/0592* (2013.01)
USPC ..... 430/59.6; 430/66; 528/206; 528/393

(58) Field of Classification Search
USPC ..... 430/59.6, 66; 528/206; 525/393
See application file for complete search history.

(56) References Cited

U.S. PATENT DOCUMENTS 3,615,414 A 10/1971 Light
3,679,408 A 7/1972 Kryman et al.
5,744,203 A * 4/1998 Harada et al. ..... 428/1.23
6,258,498 B1 7/2001 Kawahara et al.
2005/0208416 A1* 9/2005 Bender ..... 430/270.1

FOREIGN PATENT DOCUMENTS

| | | |
|---|---|---|
| EP | 1 640 807 | 6/2008 |
| JP | 8-146641 | 6/1996 |
| JP | 9-59366 | 3/1997 |
| JP | 11-65136 | 3/1999 |
| JP | 2000-275874 | 10/2000 |
| JP | 2006-65083 | 3/2006 |

OTHER PUBLICATIONS

International Search Report dated Sep. 18, 2007 in the International (PCT) Application PCT/JP2007/066146 of which the present application is the U.S. National Stage.
Supplementary European Search Report issued Feb. 20, 2012 in corresponding European Application No. 07792759.8.

* cited by examiner

*Primary Examiner* — Mark F Huff
*Assistant Examiner* — Rachel Zhang
(74) *Attorney, Agent, or Firm* — Wenderoth, Lind & Ponack, L.L.P.

(57) ABSTRACT

An electrophotographic photoreceptor belt which is excellent in durability and therefore little cracks even when fingerprints of an operator or hand cream adheres to the belt, wherein a binder resin for photosensitive layers comprising as the main component a polycarbonate resin which comprises bisphenol A type constituent units represented by the formula (I) as the main constituent unit (preferably in an amount of at least 90% by weight based on the whole of the constituent units) and which has a limiting viscosity of 1 to 1.6 dl/g and preferably a molecular weight distribution of 3.2 to 4.3 as calculated from the weight-average molecular weight and number-average molecular weight determined by GPC is used in a photosensitive layer (particularly carrier transport layer) of the belt.

(I)

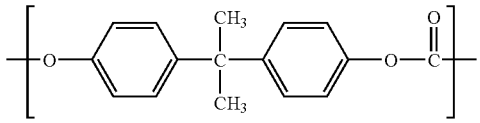

5 Claims, No Drawings

BINDER RESIN FOR PHOTOSENSITIVE LAYERS AND ELECTROPHOTOGRAPHIC PHOTORECEPTOR BELTS

TECHNICAL FIELD

The present invention relates to a binder resin comprising a qualified polycarbonate resin which is suitably used for a photosensitive layer, particularly a charge transport layer of a multilayer type photosensitive layer of an electrophotographic photoreceptor belt and an electrophotographic photoreceptor belt having a photosensitive layer using the same which is excellent in durability.

BACKGROUND ART

Currently, as a technology which enables with ease a high speed, miniaturization, and an increase in the size of copying machines and laser beam printers (hereinafter, "LBP"), an electrophotographic photoreceptor belt wherein the electrophotographic photoreceptor is formed in the shape of a belt has been developed.

The electrophotographic photoreceptor belt has an advantage that a metal drum having a large diameter as conventional photoreceptors is not required and a wider photoreceptor can be developed in the same volume. Therefore, it is suitable for miniaturization of an equipment and high-speed printing of a large-sized print such as a poster.

The mainstream of an electrophotographic photoreceptor belt is that wherein a photosensitive layer (a photoconductive layer, or in case when it is of multilayer type, a charge generating layer and a charge transport layer) is formed on a conductive support belt substrate such as a film of stainless steel or an aluminum metallized polyethylene terephthalate to form an electrophotographic photoreceptor belt. Among them, an electrophotographic photoreceptor belt wherein polycarbonate is used for a photosensitive layer, particularly for a charge transport layer is known (see Patent Document 1 and Patent Document 2).

These electrophotographic photoreceptor belts are required to be exchanged after copying on a certain number of paper since it is worn and deteriorated by friction of a transfer belt, paper, a cleaning blade or the like. However, in case when an operator touches with bare hands at the time of exchange, it may occur that cracks begin to generate at the touched point to cause shortening of a service life of the belts, and thus there is a room for improvement.

Patent Document 1: Jpn. Pat. Laid-Open Publication No. H6-236045

Patent Document 4: Jpn. Pat. Laid-Open Publication No. H10-111579

DISCLOSURE OF THE INVENTION

Problems to be Solved by the Invention

The problem to be solved by the present invention is to provide an electrophotographic photoreceptor belt excellent in durability which generates little cracks even when fingerprints or hand cream of an operator adheres to the belt.

Means for Solving the Problems

The inventors of the present invention paid intensive research efforts to dissolve the conventional problems and, as a result, they found that an electrophotographic photoreceptor belt which is excellent in crack resistance can be obtained by using a polycarbonate resin which comprises bisphenol A as the main component and which has an intrinsic viscosity of the specific range as a binder resin for the electrophotographic photoreceptor, and thus completed the present invention.

Thus, the present invention relates to a binder resin for photosensitive layers and an electrophotographic photoreceptor belt shown below.

1) A binder resin for photosensitive layers of an electrophotographic photoreceptor belt comprising as the main component a polycarbonate resin which comprises a constituent unit derived from bisphenol A represented by the following formula (I) as the main constituent unit and which has an intrinsic viscosity of 1 to 1.6 dl/g.

[Chemical Formula 1]

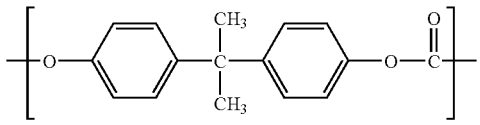

(I)

2) The binder resin for photosensitive layers according to (1), wherein the content of said constituent unit derived from bisphenol A represented by the formula (I) is not less than 90% by weight based upon the total constituent units of the polycarbonate resin.

3) The binder resin for photosensitive layers according to (1) or (2), wherein said polycarbonate resin has a molecular weight distribution in the range of 3.2 to 4.3 as calculated from the weight-average molecular weight and number-average molecular weight determined by gel permeation chromatography.

4) The binder resin for photosensitive layers according to any one of (1) to (3), characterized in that it comprises a silicone resin other than said polycarbonate resin.

5) The binder resin for photosensitive layers according to (4), wherein said silicone resin is silicone-copolymerized polyurethane.

6) An electrophotographic photoreceptor belt having a photosensitive layer on a conductive support belt substrate, characterized in that a binder resin for photosensitive layers according to any one of (1) to (5) is used as a binder resin for said photosensitive layer.

7) The electrophotographic photoreceptor belt according to (6), characterized in that said photosensitive layer comprises a charge generating layer and a charge transport layer and said binder resin for photosensitive layers is used at least as a binder resin for said charge transport layer.

Effects of the Invention

According to the present invention, by using a bisphenol A type polycarbonate resin having an intrinsic viscosity within a certain range as a binder resin for photosensitive layers (particularly for a charge transport layer), an electrophotographic photoreceptor belt which is excellent in crack resistance on a portion where fingerprints, hand cream or the like adhere and has high durability.

BEST MODE FOR CARRYING OUT THE INVENTION

(1) Structure of Electrophotographic Photoreceptor Belt

The electrophotographic photoreceptor belt of the present invention has a photosensitive layer (photoconductive layer)

on a conductive support belt substrate. The photosensitive layer is formed of a material wherein a charge generating material which generates charge by exposure to light and a charge transport material which transports charge are dispersed in a binder resin. The structure of the photosensitive layer is not particular limited. It can be of single-layer type wherein the charge generating material and the charge transport material are dispersed together in a binder resin, or it can also be of multilayer type which is formed of a combination of multiple layers functionally separated.

Examples of the multilayer type include a photosensitive layer comprising two layers which are a charge generating layer wherein a charge generating material is dispersed in a binder resin and a charge transport layer wherein a charge transport material is dispersed in a binder resin. In general, a charge generating layer is formed on the conductive support belt substrate and a charge transport layer is formed on the charge generating layer The electrophotographic photoreceptor belt of the present invention is preferably an electrophotographic photoreceptor belt having a multilayer type photosensitive layer comprising two layers of a charge generating layer and a charge transport layer. The order of the layers is preferably "a conductive support belt substrate/a charge generating layer/a charge transport layer".

In addition, the electrophotographic photoreceptor belt of the present invention can have a protection layer, an adhesive layer or the like if necessary. The protection layer can be formed on the surface of the photosensitive layer for the purpose of a hard coat. The adhesive layer can be formed between the conductive support belt substrate and the photosensitive layer for the purpose of an excellent adhesion of the conductive support belt substrate with the photosensitive layer.

(2) Conductive Support Belt Substrate

As the conductive support belt substrate to be used for the electrophotographic photoreceptor belt of the present invention, a metallic material such as aluminum, stainless steel or nickel, or a polyester film, a phenol resin film or paper having an electrically conductive layer of aluminum, palladium, tin oxide, indium oxide or the like on the surface thereof can be used.

Furthermore, it is possible to reinforce by coating a resin such as polycarbonate, polyarylate, polyethylene terephthalate, polybutylene terephthalate, polyethylene naphthalate, polybutylene naphthalate and polyimide.

Among them, an aluminum metallized polyester is particularly preferable. Though the thickness of the conductive support belt substrate is not particularly limited, it is preferably in the range of 20 to 100 μm.

(3) Photosensitive Layer

The electrophotographic photoreceptor belt of the present invention has a photosensitive layer formed on the conductive support belt substrate. The photosensitive layer is formed by a binder resin wherein a charge generating material which generates charge by exposure to light and a charge transport material which transport charge are dispersed.

As a charge generating material, organic pigments of azoxybenzenes, disazo compounds, trisazo compounds, benzimidazoles, polycyclic quinolines, indigoids, quinacridones, phthalocyanines, perylenes, methines and the like can be used. The charge generating material can be used each independently, or two or more of them can be used in combination with each other.

Examples of charge transport materials include polytetracyanoethylene; fluorenone compounds such as 2,4,7-trinitro-9-fluorenone; nitro compounds such as dinitroanthracene; succinic anhydride; maleic anhydride; dibromo maleic anhydride; triphenylmethane compounds; oxadiazole compounds such as 2,5-di(4-dimethylaminophenyl)-1,3,4-oxadiazole; styryl compounds such as 9-(4-diethylaminostyryl)anthracene; stilbene compounds such as 4-(2,2-bisphenylethene-1-il)triphenylamine and 4-(2,2-bisphenyl-ethen-1-yl)-4',4"-dimethyltriphenylamine; carbazole compounds such as triphenylamine-poly(N-vinylcarbazole); pyrazoline compounds such as 1-phenyl-3-(p-dimethylaminophenyl) pyrazoline; amine derivatives such as 4,4',4"-tris(N,N-diphenylamino)triphenylamine and N,N'-bis(3-methylphenyl)-N,N'-bis(phenyl)benzidine; conjugated unsaturated compounds such as 1,1-bis(4-diethylaminophenyl)-4,4-diphenyl-1,3-butadiene, hydrazone compounds such as 4-(N,N-diethylamino)benzaldehyde-N,N-diphenylhydrazaone; nitrogen-containing cyclic compounds such as indole compounds, oxazole compounds, isooxazole compounds, thiazole compounds, thiadiazole compounds, imidazole compounds, pyrazole compounds, pyrazoline compounds and triazole compounds, and condensed polycyclic compounds. The above-listed charge transport materials can be used each independently, or two or more of them can be used in combination with each other.

(4) Binder Resin for Photosensitive Layer

According to the present invention, a polycarbonate resin comprising, as the main constituent unit, a constituent unit derived from bisphenol A (=2,2-bis(4-hydroxyphenyl)propane) represented by the following formula (I) is used as a binder resin.

[Chemical Formula 2]

(I)

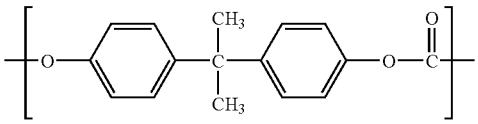

In said polycarbonate resin, it is preferable that the content of the above-mentioned constituent unit derived from bisphenol A represented by the formula (I) is not less than 90% by weight based upon the total constituent units constituting the polycarbonate resin. Furthermore, said polycarbonate resin is preferably a bisphenol A type polycarbonate resin wherein the content of the above-mentioned constituent unit derived from bisphenol A represented by the formula (I) is not less than 92% by weight based upon the total constituent units.

In case when the content of the constituent unit derived from bisphenol A is less than 90% by weight, crack resistance of the electrophotographic photoreceptor belt obtained may be deteriorated.

In addition, in order that the electrophotographic photoreceptor belt of the present invention has sufficient crack resistance and a film-forming property, it is necessary that the above-mentioned polycarbonate resin used for a binder resin for photosensitive layers has an intrinsic viscosity in the range of 1 to 1.6 dl/g.

In case when the intrinsic viscosity is less than 1 dl/g, the film-forming property may be deteriorated. In case when the intrinsic viscosity is more than 1.6 dl/g, crack resistance may be deteriorated. It is more preferable that the intrinsic viscosity is in the range of 1.1 to 1.4 dl/g.

The polycarbonate resin having an intrinsic viscosity within a specific range can be produced by controlling the amount of a molecular weight adjuster to be added. More precisely, the amount of a molecular weight adjuster to be added can be adjusted in the range of 0.6 to 1.2 mol % based upon the total bisphenols.

In terms of durability and film-forming property, it is preferable that the polycarbonate resin to be used for the present invention has a molecular weight distribution (=Mw/Mn) in the range of 3.2 to 4.3, more preferably 3.4 to 4.1 as calculated from the weight-average molecular weight (hereinafter, "Mw") and number-average molecular weight (hereinafter, "Mn") determined by gel permeation chromatography (hereinafter, "GPC"), within the above-mentioned range of the intrinsic viscosity.

In case when the value of Mw/Mn is too small, it may be deteriorated in terms of a dissolution velocity. In case when the value of Mw/Mn is too large, it may be deteriorated in terms of crack resistance.

The above-mentioned polycarbonate resin to be used for the present invention can be produced by way of a known method used for producing polycarbonate from bisphenols and a carbonate-forming compound such as a direct reaction process of bisphenols and phosgene (a phosgene method) or an ester exchange reaction of bisphenols with bisarylcarbonates (a transesterification method).

Of the phosgene method and the transesterification method, the phosgene method is more preferable in view of easiness for obtaining an intrinsic viscosity of a desired range.

Moreover, in terms of maintaining crack resistance, the proportion of bisphenol A to be used is preferably not less than 90% by weight, more preferably 92% by weight based upon the total amount of the raw material bisphenols to be used for producing the above-mentioned polycarbonate resin. It is further preferable that all of the raw material bisphenols is bisphenol A.

Examples of bisphenols usable for the polycarbonate resin to be used in the present invention other than bisphenol A include 1,1'-biphenyl-4,4'-diol, bis(4-hydroxyphenyl)methane, 1,1-bis(4-hydroxyphenyl)ethane, bis(4-hydroxyphenyl) ether, bis(4-hydroxyphenyl)sulfoxide, bis(4-hydroxyphenyl) sulfide, bis(4-hydroxyphenyl)sulfone, bis(4-hydroxyphenyl) ketone, 2,2-bis(4-hydroxy-3-t-butylphenyl)propane, 2,2-bis (4-hydroxy-3-methylphenyl)propane, 1,1-bis(4-hydroxyphenyl)cyclopentane, 1,1-bis(4-hydroxyphenyl) cyclohexane, 2,2-bis(4-hydroxyphenyl)hexafluoropropane, bis(4-hydroxyphenyl)diphenylmethane, 1,1-bis(4-hydroxyphenyl)-1-phenylethane, 9,9-bis(4-hydroxyphenyl)fluorene, 9,9-bis(4-hydroxy-3-methylphenyl)fluorene, α,ω-bis [2-(p-hydroxyphenyl)ethyl]polydimethylsiloxane, α,ω-bis [3-(o-hydroxyphenyl)propyl]polydimethylsiloxane, 4,4'-[1,3-phenylene-bis(1-methylethylidene)]bisphenol, and 1,1-bis (4-hydroxyphenyl)-1-phenylethane.

Two or more of these bisphenols can be used in combination with each other.

Among them, in addition, it is particularly preferable to use a bisphenol selected from the group consisting of 2,2-bis(4-hydroxy-3-methylphenyl)propane, bis(4-hydroxyphenyl) ether, 1,1-bis(4-hydroxyphenyl)cyclohexane and 1,1-bis(4-hydroxyphenyl)-1-phenylethane, and it is further preferable to use a bisphenol selected from the group consisting of 1,1-bis(4-hydroxyphenyl)cyclohexane.

The proportion of the amount to be used of these bisphenols other than bisphenol A is preferably less than 10% by weight, more preferably 8% by weight based upon the total bisphenols.

Examples of carbonate-forming compounds include phosgenes such as phosgene or triphosgene and bisarylcarbonates such as diphenylcarbonate, di-p-tolylcarbonate, phenyl-p-tolylcarbonate, di-p-chlorophenylcarbonate, dinaphthylcarbonate or the like. Two or more of these compounds can be used in combination with each other.

According to the phosgene method, the bisphenols are generally reacted with phosgene under the presence of an acid coupling agent and a solvent. Examples of acid coupling agents include pyridine and hydroxides of alkali metals such as sodium hydroxide, potassium hydroxide or the like. Examples of solvents include methylene chloride, chloroform and monochlorobenzene.

In addition, for the purpose of accelerating the condensation polymerization reaction, a catalyst such as a tertiary amine such as triethylamine or a quaternary ammonium salt can be used. Moreover, it is preferable to add monofunctional compounds such as phenol, p-t-butylphenol, p-cumylphenol, a long-chain alkyl-substituted phenol or the like as a molecular weight adjuster for polymerization degree adjustment.

The polycarbonate resin having a specific range of intrinsic viscosity of the present invention can be produced by adding the molecular weight adjuster at the amount in the range of 0.6 to 1.2 mol % based upon the total bisphenols to be used.

If desired, an antioxidant such as sodium sulfite or hydrosulfite and/or a branching agent such as fluoroglycin, isatin bisphenol or trisphenol ethane can be added by a small amount.

Generally, it is proper to conduct the reaction in a temperature range between 0 and 150° C., preferably between 5 and 40° C. While the reaction time may vary depending on the reaction temperature, it is normally between 0.5 minutes and 10 hours, preferably between 1 minute and 2 hours. In addition, it is desirable to keep the pH of the reaction system not below 10 during the reaction.

According to the transesterification method, the bisphenols and bisarylcarbonate are mixed and reacted with each other at high temperature under reduced pressure. The reaction is generally carried out in a temperature range between 150 and 350° C., preferably between 200 and 300° C. The ultimate pressure is preferably reduced to 1 mmHg or less to remove the phenols, which are derived from said bisarylcarbonate produced as a result of the transesterification reaction, from the reaction system by distillation.

While the reaction time may vary depending on the reaction temperature and the reduced pressure level, it is generally 1 to 20 hours. The reaction is preferably carried out in an atmosphere of inert gas such as nitrogen or argon. If desired, the reaction can be carried out by adding a molecular weight adjuster, an antioxidant and/or a branching agent.

The polycarbonate resin synthesized by the above-mentioned reactions can be molded with ease by means of known wet molding methods used for producing an electrophotographic photoreceptor belt such as a solution casting method, a casting method, a spray coating method, a dip coating method or the like. Using a polycarbonate resin of the present invention having the intrinsic viscosity in the range of 1 to 1.6 dl/g, the electrophotographic photoreceptor belt molded by a wet molding can have sufficient crack resistance and a film-forming property.

Though, the binder resin for photosensitive layers of the present invention comprises the above-mentioned specific polycarbonate resin as the main component, other polymers such as other polycarbonate, polyester, polystyrene, polyamide, polyurethane, silicone resins, polymethylmethacrylate, polyoxyphenylene, polyvinylacetate and fluorine-modified polymers can also be comprised within the range that the performance of said polycarbonate is maintained.

Among them, it is preferable to add silicone resins. Examples of the silicone resins include a silicone-copolymerized polymer such as silicone-copolymerized polyurethane, silicone-copolymerized polycarbonate, silicone-copolymerized polymethylmethacrylate and silicone-copolymerized polystyrene. Among them, silicone-copolymerized polyurethane is particularly preferable.

The silicone-copolymerized polyurethane has preferably an average molecular weight of 1,000 to 30,000. It can be produced by known urethanization reaction of polyisocyanate with polyol, or is available as a commercial product. Examples of the commercial products include "Daiaromer SP"; trade name, manufactured by Dainichiseika Color and Chemicals Mfg. Co., Ltd. and "RESAMINE PS"; trade name, manufactured by Dainichiseika Color and Chemicals Mfg. Co., Ltd.

It is also preferable to add fluorine-modified polymer such as fluoroalkyl-modified polymethylmethacrylate.

In case when these other polymers are used, the amount to be blended is preferably less than 1% by weight based upon the total amount of the binder resin for photosensitive layers. Especially in case when silicone-copolymerized polyurethane is used, the amount to be blended is preferably 0.01 to 0.6% by weight based upon the total amount of the binder resin for photosensitive layers.

The above-mentioned binder resin for photosensitive layers of the present invention can further comprise known additives such as a phenolic antioxidant, a sulfuric antioxidant, a benzotriazole ultraviolet absorbent, a benzophenone ultraviolet absorbent or the like. In this case, it is preferable to use the additives in the amount of less than 1% by weight based upon the total amount of solid components.

(5) Formation of Photosensitive Layer

In case when the photosensitive layer of the electrophotographic photoreceptor belt of the present invention is of single-layer type, the binder resin for photosensitive layers of the present invention comprising the above-mentioned specific polycarbonate resin as the main component is used as a binder resin of said photosensitive layer wherein fine particles of a charge generating material and a charge transport material are dispersed homogeneously to form a photosensitive layer.

The photosensitive layer can be formed by firstly dissolving the charge generating material and charge transport material into a suitable solvent with a binder resin for photosensitive layers, then coating the solution on the conductive support belt substrate by means of a solution casting method, a casting method, a spray coating method, a dip coating method or the like, and drying the coating layer.

Solvents to be used can be roughly classified into halogen type organic solvents and non-halogen type organic solvents. Since the specific polycarbonate resin to be used for the present invention can be dissolved well in a halogen type organic solvent but is dissolved poorly in a non-halogen type organic solvent, it is preferable to use a halogen type organic solvent.

Examples of the halogen type organic solvents include a halogenated hydrocarbon solvent such as dichloromethane, chloroform, monochlorobenzene, 1,1,1-trichloroethane, monochloroethane and carbon tetrachloride. Among them, it is preferable to use dichloromethane. Examples of the non-halogen type organic solvents include aromatic hydrocarbons such as toluene and xylene, ketones such as acetone, methylethylketone, cyclohexanone and isophoron, ethers such as tetrahydrofuran, 1,4-dioxane, ethylene glycol diethyl ether and ethylcellosolve, esters such as methyl acetate and ethyl acetate as well as dimethyl formamide, dimethyl sulfoxide and diethyl formamide.

For the purpose of the present invention, any of the above-listed solvents can be used each independently, or two or more of them can be used in combination with each other.

In case when the photosensitive layer is formed by dissolving the binder resin for photosensitive layers of the present invention into the solvent, it is preferable to prepare and use a binder resin solution in the concentration range of 1 to 20% by weight.

In addition, it is also possible to recycle used electrophotographic photoreceptor belts commercially available by dissolving the photosensitive layer of said used electrophotographic photoreceptor belt with the above-listed solvents and then forming a new photosensitive layer thereon.

In case when the photosensitive layer is of single-layer type, the suitable thickness of the photosensitive layer is 10 to 60 μm, preferably 20 to 40 μm, and the mixing ratio of the charge generating material and the charge transport layer with the binder resin for photosensitive layers is preferably within a range between 2:10 and 10:2 at a weight ratio.

(6) Formation of Charge Generating Layer and Charge Transport Layer

In case when the photosensitive layer of the electrophotographic photoreceptor belt of the present invention is of multilayer type comprising a charge generating layer and a charge transport layer, it is necessary that the binder resin for photosensitive layers of the present invention comprising the above-mentioned specific polycarbonate resin as the main component is used at least as a binder resin for the charge transport layer. That is, the charge transport layer of the electrophotographic photoreceptor belt of the present invention is formed by using the above-mentioned binder resin for photosensitive layers wherein a charge transport material is dispersed homogeneously.

Binder resins for a charge generating layer is not particularly limited. Although the binder resin for photosensitive layers of the present invention can also be used, it is not limited to this. Examples of binder resins for the charge generating layer include a polyvinyl butyral resin, a polyvinyl formal resin, a silicone resin, a polyamide resin, a polyester resin, a polystyrene resin, a polycarbonate resin, a polyvinyl acetate resin, a polyurethane resin, a phenoxy resin, an epoxy resin and various celluloses. Considering the possibility of dissolution between the binder resin of the charge generating layer and that of the charge transport layer, it is preferable to use a resin other than the binder resin for photosensitive layers of the present invention for the charge generating layer. The most preferable binder resin for the charge generating layer is a polyvinyl butyral resin.

The charge generating layer is generally formed on the conductive support belt substrate and the charge transport layer is formed on the charge generating layer.

Each of the charge generating layer and charge transport layer can be formed by dissolving the above-mentioned charge generating material or charge transport material respectively into a suitable solvent with a binder resin respectively by a method similar to the above-mentioned method of forming a single-layer type photosensitive layer.

The mixing ratio of the charge generating material and the binder resin is preferably within a range between 10:1 and 1:20. The preferable thickness of the charge generating layer is 0.01 to 20 μm, more preferably 0.1 to 2 μm. The mixing ratio of the charge transport material and the binder resin is preferably within a range between 10:1 and 1:10. The preferable thickness of the charge transport layer is 2 to 100 μm, more preferably 5 to 40 μm.

EXAMPLES

The present invention will be described in more detail below referring to Examples. Note that the scope of the present invention is not limited by the following examples.

Example 1

(1) Production of Polycarbonate Resin 91.2 g (0.4 mol) of bisphenol A, manufactured by Nippon Steel Chemical Co., Ltd. in Japan (hereinafter, "BPA"), and 0.1 g of hydrosulfite were dissolved into 1100 ml of 5 w/w % aqueous solution of sodium hydroxide.

Then, 500 ml of dichloromethane was added to the aqueous solution and 60 g of phosgene was blown into the solution over a period of 60 minutes, while stirring the solution and keeping the temperature of the solution to 15° C.

After the completion of blowing phosgene in, 0.56 g of p-t-butylphenol, manufactured by Dainippon Ink And Chemicals, Inc. (hereinafter, "PTBP"), was added as a molecular weight adjuster and the reaction solution was stirred intensely to emulsify. After emulsification, 0.4 ml of triethylamine was added and the emulsion was stirred at 20 to 25° C. for about an hour for polymerization.

After the completion of the polymerization, the reaction solution was separated into an aqueous phase and an organic phase.

The organic phase was neutralized by phosphoric acid and was washed repeatedly with water until the electric conductivity of the upper solution (aqueous phase) falls not higher than 10 μS/cm. The polymer solution thus obtained was dropped into warm water held to 50° C. and the solvent was removed by evaporation to obtain a white powdery precipitate. The precipitate thus obtained was filtered and dried at 105° C. for 24 hours to obtain powder of the polymer.

The intrinsic viscosity of the solution of the polymer in the solvent of methylene chloride with a concentration of 0.2 g/dl at 20° C. was 1.23 dl/g. The molecular weight distribution of the polymer determined by GPC measurement was 3.69 (Mw=177000, Mn=48000). The polymer thus obtained was analyzed by means of infrared absorption spectrometry, and as a result, the absorption due to a carbonyl group was observed at a position near 1,770 $cm^{-1}$ and the absorption due to an ether bond was observed at a position near 1,240 $cm^{-1}$, whereby it was confirmed that the polymer was a polycarbonate resin having a carbonate bond.

(2) Formation of Electrophotographic Photoreceptor Belt

Thereafter, a coating solution was prepared by using 8 parts by weight of N,N'-bis(3-methylphenyl)-N,N'-bis(phenyl) benzidine, manufactured by SYNTEC (hereinafter, "TPD type CT agent", 8 parts by weight of the polycarbonate resin obtained as a result of the above described synthetic polymerization and 84 parts by weight of dichloromethane. The coating solution thus obtained was coated by a casting method onto a commercially available electrophotographic photoreceptor belt, manufactured by Brother Industries, Ltd., trade name; "OP-4LC", from which the charge transport layer had been removed in advance by tetrahydrofuran. Then, the coated solution was dried in flowing air and then left for drying at 60° C. for 8 hours to form an about 20 μm-thick charge transport layer to produce a multilayer type electrophotographic photoreceptor belt (hereinafter, "OPC belt").

(3) Evaluation of Crack Resistance

On an OPC belt thus prepared, an artificial fingerprint liquid based on JIS-K2246 was coated with a forefinger by a size with width of about 1.2 cm and length of about 10 cm in the vertical direction to the rotational direction.

After leaving for 10 minutes, the coated region was wiped by cotton softly. Then, said OPC belt was mounted in a commercially available digital complex machine, manufactured by Brother Industries, Ltd., trade name; "MFC-9420CN". The machine was driven to print an entirely black solid image using recycled OA paper (LPR-A4-W; manufactured by Tochiman Co., Ltd.) in a thermo-hygrostat at 25° C. and 50% RH. The printed images in every 500 sheets were checked, and when a linear image defect was observed, the presence of a crack on the photoreceptor belt (a standard being 0.1×1 mm or larger) was investigated. The printing number of sheets at the time of observing a crack was made into the index of durability.

A similar examination was carried out by coating a hand cream manufactured by Johnson & Johnson, tradename "Johnson soft lotion, URUOI 24 hour" on the OPC belt in place of the artificial fingerprint liquid. The results of crack resistance test were shown in Table 1.

Example 2

An experiment was carried out in the same manner as Example 1 except that the amount of PTBP was changed to 0.6 g and the solvent for preparing the charge transport layer is changed to 70 parts by weight of dichloromethane and 14 parts by weight of monochlorobenzene.

The intrinsic viscosity of the polycarbonate resin thus obtained was 1.15 dl/g. The molecular weight distribution thereof was 3.87 (Mw=161000, Mn=41600). The results of crack resistance test carried out in the same manner as Example 1 were shown in Table 1.

Example 3

An experiment was carried out in the same manner as Example 1 except that 91.2 g of BPA was replaced by 90.7 g of BPA and 0.5 g of 1,1-bis(4-hydroxyphenyl)cyclohexane, manufactured by Taoka Chemical Co., Ltd. in Japan (hereinafter, "BPZ"). The intrinsic viscosity of the polycarbonate resin thus obtained was 1.20 dl/g. The molecular weight distribution thereof was 3.95 (Mw=170000, Mn=43000). The results of crack resistance test carried out in the same manner as Example 1 were shown in Table 1.

An experiment was carried out in the same manner as Example 1 except that, at the time of preparing the solution for a charge transport layer, 0.1% by weight of silicone-copolymerized polyurethane, manufactured by Dainichiseika Color and Chemicals Mfg. Co., Ltd., trade name; "Daiaromer SP" (hereinafter, "SiPU") based upon the polycarbonate resin was added to prepare the charge transport layer solution. The results of crack resistance test carried out in the same manner as Example 1 were shown in Table 1.

Example 5

An experiment was carried out in the same manner as Example 1 except that 91.2 g of BPA was replaced by 84.8 g of BPA and 6.4 g of 1,1-bis(4-hydroxyphenyl)cyclohexane, manufactured by Taoka Chemical Co., Ltd. in Japan (hereinafter, "BPZ").

The intrinsic viscosity of the polycarbonate resin thus obtained was 1.14 dl/g. The molecular weight distribution thereof was 4.08 (Mw=164000, Mn=40200). The results of crack resistance test carried out in the same manner as Example 1 were shown in Table 1.

Comparative Example 1

An experiment was carried out in the same manner as Example 1 except that the polycarbonate resin used in Example 1 was replaced by a BPZ type homopolycarbonate resin, manufactured by Mitsubishi Gas Chemical Co., Inc., tradename "PCZ-800", intrinsic viscosity: 1.35 dl/g, molecular weight distribution: 8.17 (Mw=267000, Mn=32700), which is a commercially available binder resin for an electrophotographic photoreceptor. The results were shown in Table 1.

Comparative Example 2

An experiment was carried out in the same manner as Example 1 except that the polycarbonate resin used in Example 1 was replaced by a copolycarbonate resin of 1,1'-biphenyl-4,4'-diol and BPA, manufactured by Idemitsu Kosan Co., Ltd., trade name; "Tough Z B-300", intrinsic viscosity: 0.74 dl/g, molecular weight distribution: 1.99 (Mw=780000, Mn=39200). The results were shown in Table 1.

Comparative Example 3

An experiment was carried out in the same manner as Example 1 except that the polycarbonate resin used in Example 1 was replaced by a commercially available BPA type homopolycarbonate resin, manufactured by Mitsubishi Gas Chemical Co., Inc., tradename "K-4000", intrinsic viscosity: 0.77 dl/g, molecular weight distribution: 3.12 (Mw=86100, Mn=27600). The results were shown in Table 1.

Terms in the Table 1 represent as follows:

Bisphenol content: the ratio of each bisphenol based upon the total amount of bisphenols (% by weight)

BPA: 2,2-bis(4-hydroxyphenyl)propane

BPZ: 1,1-bis(4-hydroxyphenyl)cyclohexane

BP: 1,1'-biphenyl-4,4'-diol

Additive: silicone-copolymerized polyurethane

Intrinsic Viscosity: A value observed by means of an Ubbelohde tube at 20° C. with a 0.2% dichloromethane solution and a Haggins constant of 0.45.

Molecular Weight Distribution: Measured by using an instrument, manufactured by Waters Corporation, tradename; "alliance HPLC System", with two columns manufactured by Showa Denko K.K., tradename; "Shodex 805L", under the conditions of 0.25 w/v % chloroform solution sample, 1 ml/min chloroform eluent, and UV ray detection. Then the molecular weight distribution was determined by a weight average molecular weight and number average molecular weight in terms of polystyrene.

Fingerprint Liquid: The artificial fingerprint liquid based on JIS-K2246 was prepared by blending the following commercially available reagents: 500 ml of purified water, 500 ml of methanol, 7 g of sodium chloride, 1 g of urea and 4 g of lactic acid.

Hand Cream Johnson soft lotion, trade name; "URUOI 24-hour", manufactured by Johnson & Johnson K.K.

INDUSTRIAL APPLICABILITY

By using the binder resin for photosensitive layers of the present invention, an electrophotographic photoreceptor belt having high durability against occurrence of a crack at a polluted portion by stain such as fingerprints or hand cream.

What is claimed is:

1. An electrophotographic photoreceptor belt having a photosensitive layer on a conductive support belt substrate, said photosensitive layer comprising a binder resin for a photosensitive layer, wherein said binder resin comprises a polycarbonate resin as a main component and a silicone-copolymerized polyurethane as an additional polymer, wherein:

said polycarbonate resin comprises a constituent unit derived from bisphenol A represented by the following formula (I) as a main constituent unit, said polycarbonate resin has an intrinsic viscosity of 1 to 1.6 dl/g, and

TABLE 1

| | Bisphenol Components (% by weight) | | Additional | Intrinsic Viscosity | Molecular Weight Distribution | Printing Number of Sheets at the time of crack generation | |
|---|---|---|---|---|---|---|---|
| | BPA | Others | Treatment | (dl/g) | (Mw/Mn) | Fingerprint Solution | Hand Cream |
| Example | | | | | | | |
| 1 | 100 | | | 1.23 | 3.69 | 20000 | 14000 |
| 2 | 100 | | | 1.15 | 3.87 | 19500 | 13500 |
| 3 | 99.5 | 0.5 | | 1.20 | 3.95 | 18000 | 12500 |
| 4 | 100 | | Additive | 1.23 | 3.69 | 22000 | 15500 |
| Comparative Example | | | | | | | |
| 1 | | BPZ (100) | | 1.35 | 8.17 | 10000 | 5500 |
| 2 | 87 | BP (13) | | 0.74 | 1.99 | 13500 | 8000 |
| 3 | 100 | | | 0.77 | 3.12 | 15500 | 10000 |

an amount of said silicone-copolymerized polyurethane is 0.1 to 0.6% by weight based upon a total amount of said binder resin,

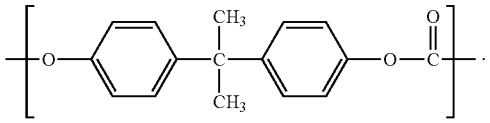

2. The electrophotographic photoreceptor belt according to claim 1, wherein:

said photosensitive layer further comprises a charge generating layer and a charge transport layer, and said binder resin for a photosensitive layer is used at least as a binder resin for said charge transport layer.

3. The electrophotographic photoreceptor belt having a photosensitive layer on a conductive support belt substrate according to claim 1, wherein in the binder resin, a content of said constituent unit derived from bisphenol A represented by the formula (I) is not less than 90% by weight based upon a total constituent units of said polycarbonate resin.

4. The electrophotographic photoreceptor belt having a photosensitive layer on a conductive support belt substrate according to claim 3, wherein in the binder resin, said polycarbonate resin has a molecular weight distribution (Mw/Mn) in a range of 3.2 to 4.3 as calculated from a weight-average molecular weight (Mw) and a number-average molecular weight (Mn) determined by gel permeation chromatography.

5. The electrophotographic photoreceptor belt having a photosensitive layer on a conductive support belt substrate according to claim 1, wherein in the binder resin, said polycarbonate resin has a molecular weight distribution (Mw/Mn) in a range of 3.2 to 4.3 as calculated from a weight-average molecular weight (Mw) and a number-average molecular weight (Mn) determined by gel permeation chromatography.

* * * * *